US010448147B2

(12) United States Patent
Seo et al.

(10) Patent No.: US 10,448,147 B2
(45) Date of Patent: Oct. 15, 2019

(54) ACOUSTIC DEVICE HAVING MULTIPLE DIAPHRAGMS

(71) Applicant: BUJEON CO., LTD., Ansan-si (KR)

(72) Inventors: Donghyeon Seo, Ansan-si (KR); Minkoo Park, Hwaseong-si (KR); Minkyeom Kim, Yangju-si (KR)

(73) Assignee: BUJEON CO., LTD., Ansan-si (KR)

( * ) Notice: Subject to any disclaimer, the term of this patent is extended or adjusted under 35 U.S.C. 154(b) by 0 days.

(21) Appl. No.: 16/212,858

(22) Filed: Dec. 7, 2018

(65) Prior Publication Data

US 2019/0191239 A1 Jun. 20, 2019

(30) Foreign Application Priority Data

Dec. 20, 2017 (KR) ..... 10-2017-0175736

(51) Int. Cl.
*H04R 1/24* (2006.01)
*H04R 7/12* (2006.01)
*H04R 1/10* (2006.01)

(52) U.S. Cl.
CPC ..... *H04R 1/24* (2013.01); *H04R 1/1016* (2013.01); *H04R 1/1091* (2013.01); *H04R 7/12* (2013.01)

(58) Field of Classification Search
None
See application file for complete search history.

(56) References Cited

U.S. PATENT DOCUMENTS

2008/0240486 A1* 10/2008 Garcia ..... H04R 1/1016 381/380
2015/0163583 A1* 6/2015 Howes ..... H04R 1/1016 381/380
2016/0261944 A1* 9/2016 Silvestri ..... H04R 1/2826
2017/0093079 A1* 3/2017 Wagman ..... A45C 13/02
2017/0289667 A1* 10/2017 Okita ..... H04R 1/1016
2018/0070165 A1* 3/2018 Hatfield ..... H04R 1/1016

FOREIGN PATENT DOCUMENTS

KR 10-1176300 B1 8/2012

OTHER PUBLICATIONS

Auction, non-slip holdable pad for vehicle, http://itempage3.auction.co.kr/detailView.aspx?ItemNo=A962472597&keyword=%b3%ed%bd%bd%b8%b3%c6%d0%b5%e5&scoredtype=2.

* cited by examiner

*Primary Examiner* — Paul W Huber
(74) *Attorney, Agent, or Firm* — Korus Patent, LLC; Seong Il Jeong

(57) ABSTRACT

The inside of the housing of an acoustic device, such as an earphone, is divided into two or more spaces based on a driver. Diaphragms are disposed to cover a nozzle communicating with an ear of a user and a vent hole formed in the back of the housing. Optimum sound quality can be secured by adjusting the sizes of the spaces formed by the diaphragms and the housing and the locations where the diaphragms are disposed. When the housing is of a sealed type, low-band sound pressure can be effectively prevented from being lost.

7 Claims, 7 Drawing Sheets

ACOUSTIC DEVICE HAVING MULTIPLE DIAPHRAGMS

CROSS-REFERENCE TO RELATED APPLICATION

This application claims the benefit of Korean Patent Application No. 10-2017-0175736 filed on Dec. 20, 2017, which is hereby incorporated by reference herein in its entirety.

BACKGROUND

1. Technical Field

The present invention relates to an acoustic device having multiple diaphragms.

2. Description of the Related Art

In an earphone, a dynamic unit, such as a speaker module, generally has a single diaphragm.

Technologies having two or more diaphragms include, e.g., U.S. Patent Application Publication No. 2017-0188126. This patent publication discloses an earphone configured such that a diaphragm 5" is further installed at an entrance directed toward an ear in addition to a vibrator 8," as shown in FIG. 1*a*, the diaphragm 5" is selectively opened and closed around a hinge 5*a*' by a user's operation of pressing a button 4*a*,' and a surrounding sound can be heard or a sound signal can be transferred from the vibrator 8." Although this conventional technology is advantageous in that a user can hear a surrounding sound without removing the earphone during the use of the earphone, the diaphragm 5" is not a member that is used to improve sound quality.

Another acoustic device is a large amplifier-type speaker device configured such that a passive diaphragm 30" is provided on the back surface of a cabinet in order to reproduce rich low tones. For example, Korean Patent No. 10-162208 discloses a technology that reproduces low tones and emits the low tones to the back surface of the cabinet in such a manner that the vibration generated by a diaphragm 20" disposed to face an opening 11" is directly transferred to the passive diaphragm 30" through a transfer member 90." However, this conventional technology is disadvantageous in that it is inconvenient to install the transfer member 90" and design is limited.

Existing acoustic devices including earphones do not take into account effectively adjusting loudness and effectively improving sound quality by arranging a plurality of diaphragms inside a device.

SUMMARY

An object of the present invention is to provide an acoustic device having multiple diaphragms, in which a plurality of diaphragms is arranged inside the acoustic device, thereby effectively adjusting loudness and effectively improving sound quality.

In order to accomplish the above object, an embodiment of the present invention provides an acoustic device having multiple diaphragms, the acoustic device including: a housing configured to form the appearance of the acoustic device while surrounding the acoustic device; a driver disposed inside the housing, and including a main diaphragm; and an additional diaphragm disposed at a boundary of a space formed by the housing or adjacent to the boundary.

The space formed by the housing includes a first space formed on one side and a second space formed at a side opposite to the one side based on the driver, and the additional diaphragm includes a first diaphragm disposed at a boundary of the first space or adjacent to the boundary.

The additional diaphragm may further include a second diaphragm disposed at a boundary of the second space or adjacent to the boundary.

The first space and the second space may be formed as spaces, sealed from an outside, by the first diaphragm and the second diaphragm.

Another embodiment of the present invention provides an earphone having multiple diaphragms, the earphone including: a housing configured to form the appearance of the earphone while surrounding the earphone; a driver disposed inside the housing, and including a main diaphragm; and an additional diaphragm disposed at the boundary of a space formed by the housing or adjacent to the boundary; wherein the space formed by the housing includes a first space formed on one side and a second space formed at a side opposite to the one side based on the driver, and the additional diaphragm includes a first diaphragm disposed at a boundary of the first space or adjacent to the boundary.

The additional diaphragm may further include a second diaphragm disposed at a boundary of the second space or adjacent to the boundary.

The first space and the second space may be formed as spaces, sealed from an outside, by the first diaphragm and the second diaphragm.

The housing may include a nozzle configured to emit sound to an inside of an ear of a user in the first space, and the first diaphragm may be disposed at a location that covers the nozzle.

The housing may have an opening formed behind the second space as a vent hole, and the second diaphragm may be disposed at a location that covers the opening.

The second diaphragm may be a mesh-type membrane that passes air therethrough and does not pass water therethrough.

BRIEF DESCRIPTION OF THE DRAWINGS

The above and other objects, features, and advantages of the present invention will be more clearly understood from the following detailed description taken in conjunction with the accompanying drawings, in which.

DETAILED DESCRIPTION

The object and effects of the present invention and technical configurations for achieving the object and the effects will be apparent from embodiments that will be described in detail below with reference to the accompanying drawings. In the following description of the present invention, when it is determined that a detailed description of a well-known function or configuration may make the gist of the present invention unnecessarily obscure, it will be omitted.

Throughout the specification and the claims, when any portion is described as including any component, this is not intended to exclude another component, but is intended to include another component, unless particularly described to the contrary. Meanwhile, in the embodiments of the present invention, each component, function block, or means may include one or more subordinate components. The electrical, electronic, or mechanical function performed by each component may be implemented by one or more of various well-known devices or mechanical elements, such as an electric circuit, an integrated circuit, an application specific integrated circuit (ASIC), etc. Such functions may be implemented individually or in an integrated manner.

The present invention is characterized in that a plurality of diaphragms is located within the frame of an acoustic device, i.e., at the boundaries of spaces formed by a housing. More specifically, the present invention is characterized in that the inside of the housing of an acoustic device is divided into two or more spaces based on a driver and the boundary of at least part of each of the spaces is formed by a corresponding one of the diaphragms. Accordingly, optimum sound quality can be secured and low-band sound pressure can be prevented from being lost by adjusting the sizes of the spaces and the locations where the diaphragms are disposed.

The present invention may be applied to all types of acoustic devices including an earphone and a speaker. In the following description, a description will be given based on an earphone as a specific example.

Figure 1A:
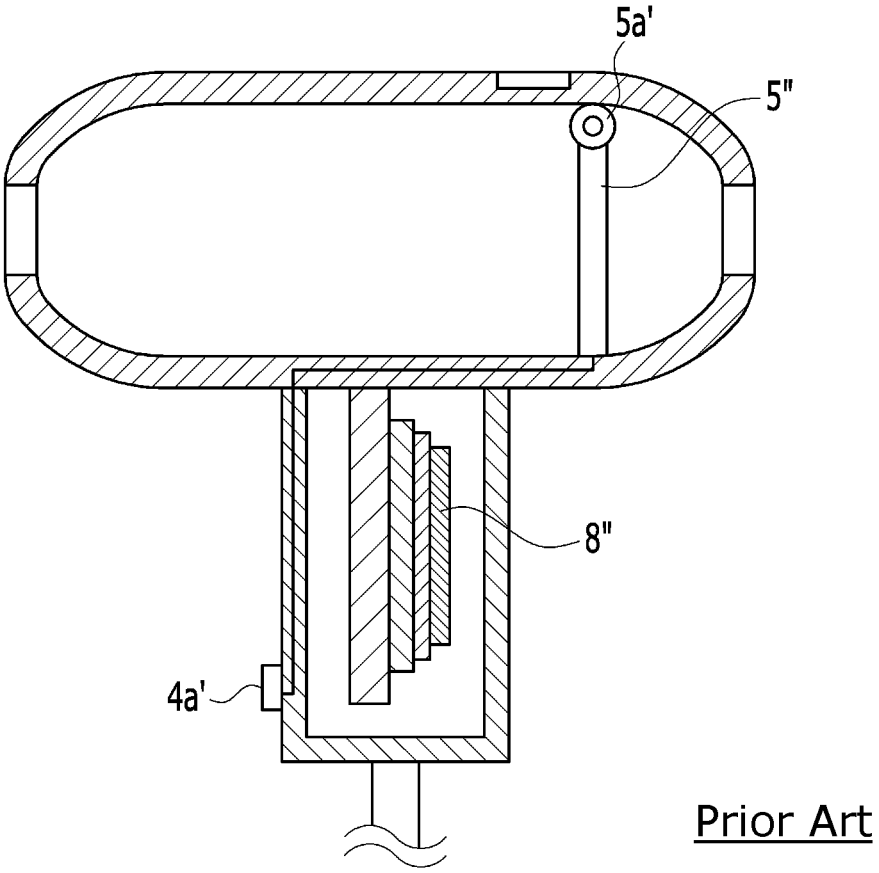
FIG. 1*a* is a view showing an earphone structure according to a conventional technology.
Figure 1B:
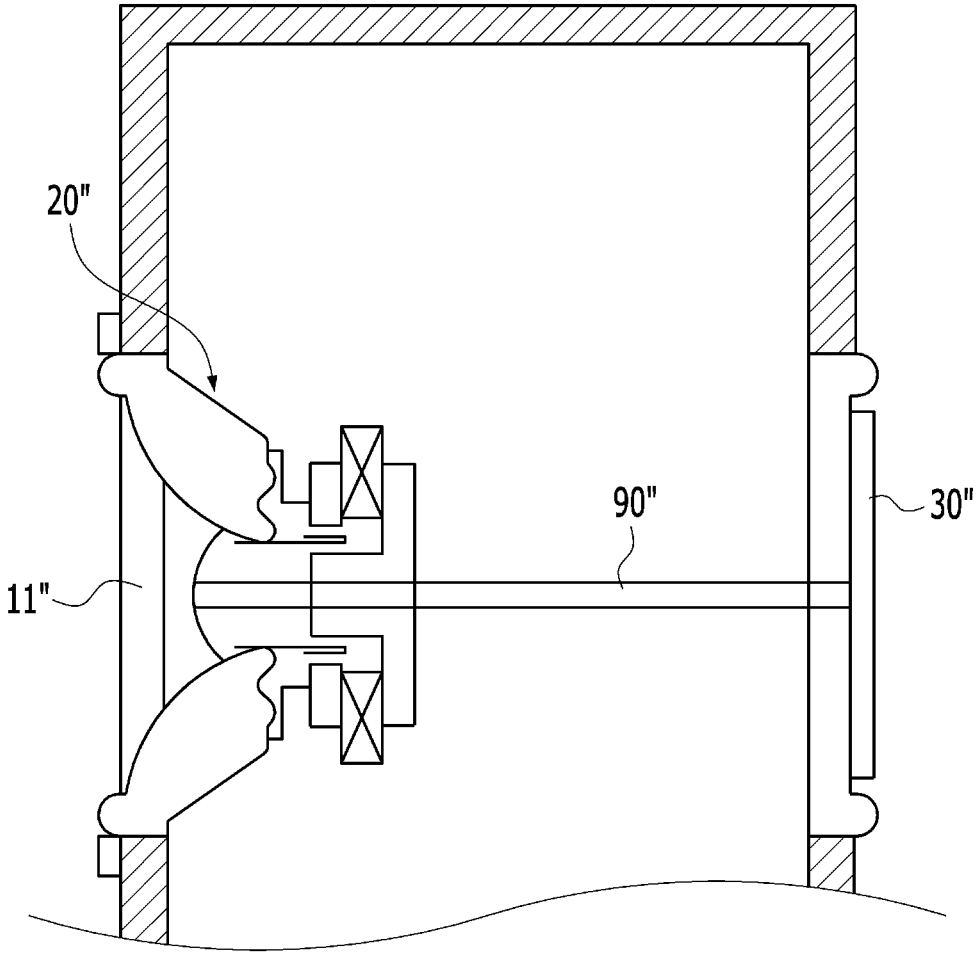
Prior Art FIG. 1B
FIG. 1*b* is a view showing an earphone structure according to another conventional technology.
Figure 2:
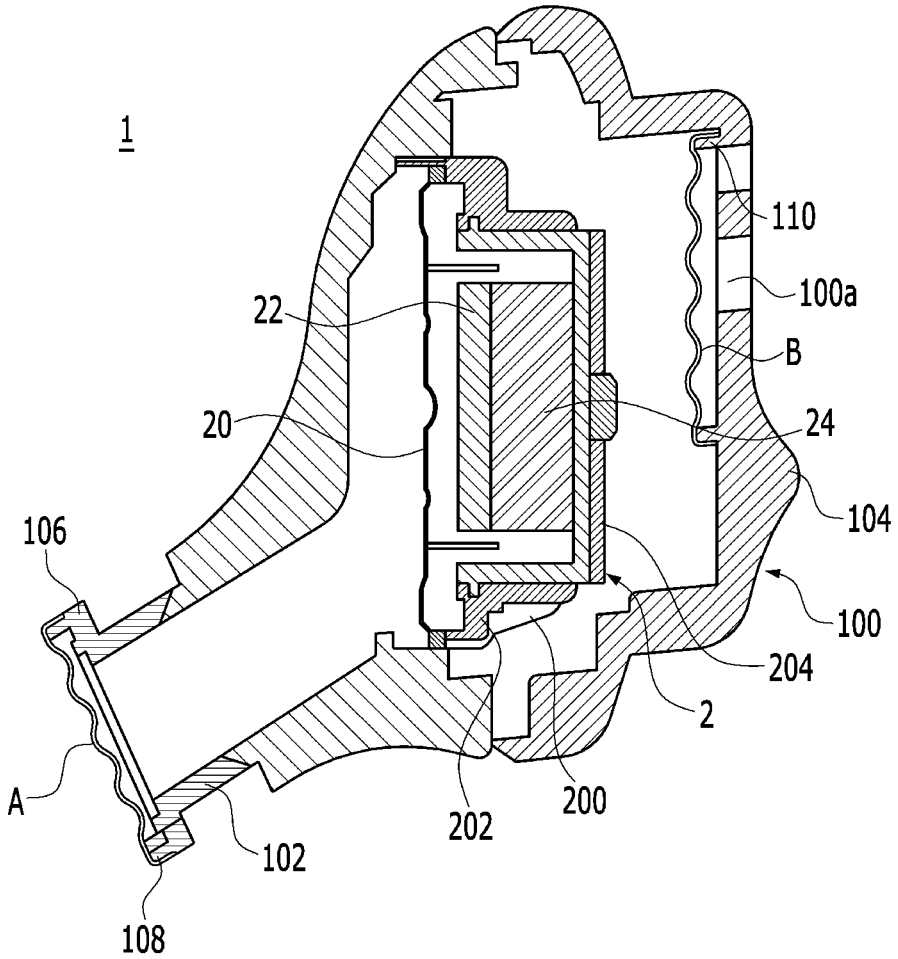
FIG. 2 is a longitudinal sectional view of an earphone having multiple diaphragms according to an embodiment of the present invention.
Figure 3:
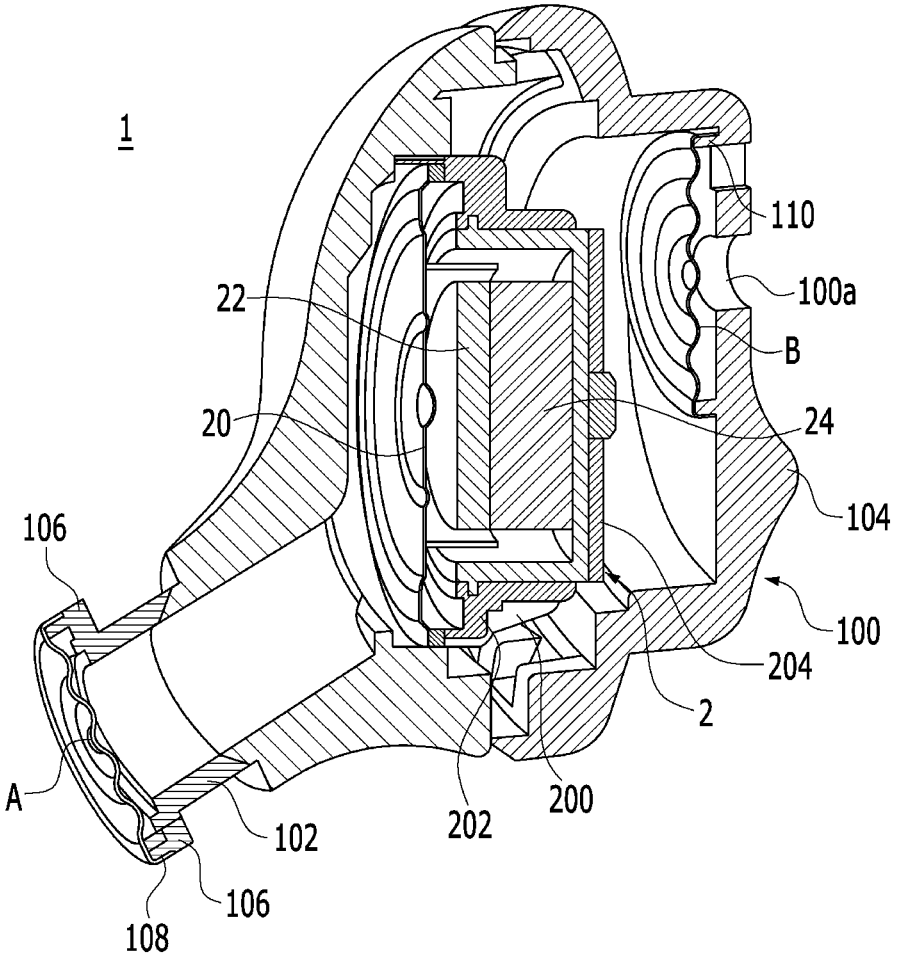
FIG. 3 is a perspective view of the earphone of FIG. 2.

FIG. 2 is a longitudinal sectional view of an earphone 1 having multiple diaphragms according to an embodiment of the present invention, and FIG. 3 is a perspective view of the earphone 1 of FIG. 2. In these drawings, a left direction refers to a direction toward the inside of an ear, e.g., the external auditory meatus, and a downward direction refers to a direction toward the outside. For the sake of convenience, the left direction may be also referred to as a forward direction or front surface direction, and a right direction may be also referred to as a rearward direction or rear surface direction.

In the present invention, diaphragms are construed as including not only airtight structure plates but also waterproof structure membranes that can pass air therethrough.

Referring to the two drawings together, a housing 100 forms the appearance of the earphone 1, and includes a nozzle 102, side surfaces, and rear surface 104 sequentially from the front thereof. A driver 2 is mounted inside a cylindrical space formed by the housing 100. The driver 2 refers to a sound reproduction part or module including a balanced armature (BA), a piezoelectric or electrostatic transducer, or an electromagnet part. An opening 100*a* is formed through the rear surface 104 as a vent hole. An earplug (not shown) may be inserted in front of the nozzle 102.

The housing 100 is an example thereof, and may be appropriately adjusted according to the change or development of the earphone 1.

The frame of the driver 2 is defined by a casing 200. The casing 200 including side surfaces 202 and a rear surface 204 is fabricated in an integrated manner. The driver 2 may be any existing one. The shown driver 2 includes a main diaphragm 20 including three domes, and an upper plate 22 and a yoke 24 sequentially disposed below the main diaphragm 20. A magnet (not shown) is mounted on the yoke 24.

A flange 106 is formed along the front outer circumference of the nozzle 102 of the earphone 1 according to the embodiment of the present invention, and a lip portion 108 is disposed on the front of the flange 106. A first diaphragm A is disposed in front of the lip portion 108. The first diaphragm A is disposed to cover the nozzle 102. It is preferred that the first diaphragm A is tightly disposed to seal the front of the housing 100.

Furthermore, a rib 110 is formed at a portion facing the opening 100*a* of the rear surface 104, and a second diaphragm B is disposed in front of the rib 110. The second diaphragm B is disposed to cover the opening 100*a*. It is preferred that the second diaphragm B is tightly disposed to seal the rear surface 104 of the housing 100. Alternatively, the second diaphragm B may be a mesh-type waterproof membrane that passes air therethrough but does not pass water therethrough.

Although the first diaphragm A and the second diaphragm B may be made of an elastic material, e.g., silicon, it may be made of any existing material as long as the material can facilitate vibration. The shapes of the first and second diaphragms A and B are not particularly limited. Furthermore, in the present invention, the first and second diaphragms A and B are construed as including not only airtight structure plates but also waterproof structure membranes that can pass air therethrough. Furthermore, not only a typical kernel-type earphone but also flat diaphragms or corrugated diaphragms each integrated with a voice coil may be employed. Furthermore, unlike the shown first and second diaphragms, the first diaphragm A may be disposed inside the nozzle 102 and the second diaphragm B may be disposed outside the housing 100. In other words, the locations where the first and second diaphragms are disposed are not limited.

Figure 4:
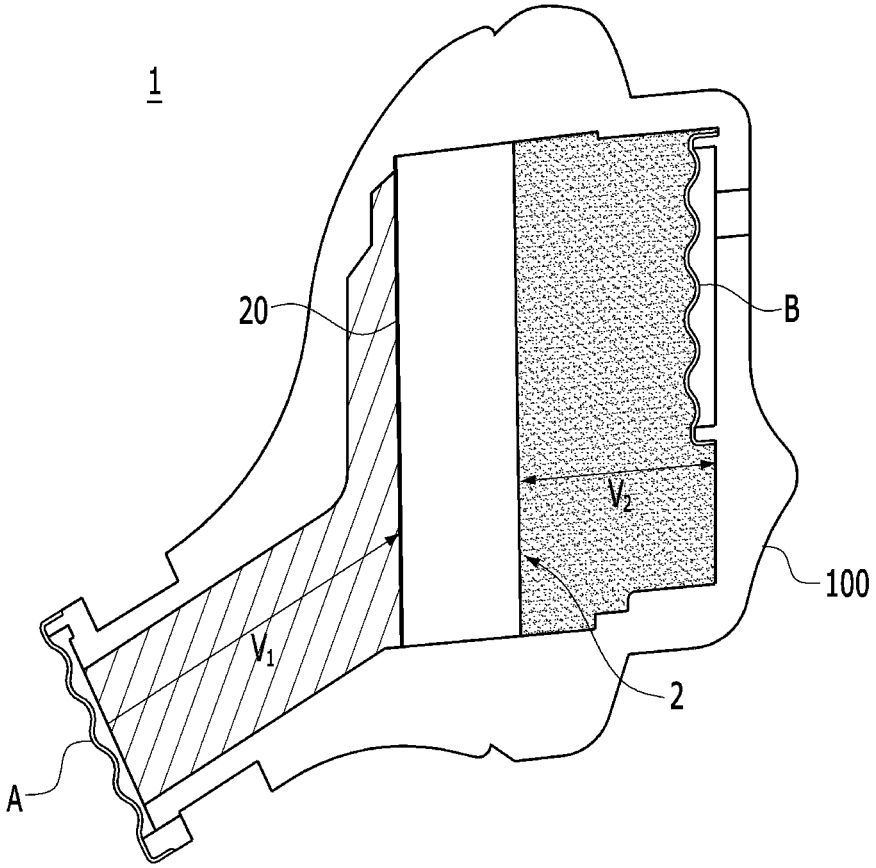
FIG. 4 is a conceptual diagram illustrating the sound adjustment function of the earphone having multiple diaphragms based on the embodiment of the present invention.

FIG. 4 is a conceptual diagram illustrating the sound adjustment function of the earphone 1 including multiple diaphragms based on the above-described embodiment of the present invention. The individual elements thereof are conceptually illustrated.

The frame of the earphone 1 is defined by the housing 100. The inside of the earphone 1 is divided into a front first space $V_1$ and a rear second space $V_2$ based on the driver 2.

The first space $V_1$ and the second space $V_2$ may be blocked from each other in an airtight manner, or may communicate with each other via the path of the housing 100 or the communication path of the driver 2 that is not shown.

When the main diaphragm 20 of the driver 2 is driven, the first diaphragm A is driven by the vibration transferred via the first space $V_1$. Sound is reproduced by the driving of the first diaphragm A forward. When the first space $V_1$ is sealed and has a predetermined or smaller volume, the vibration of the main diaphragm 20 is transferred to the first diaphragm A almost without loss. As the first diaphragm A is disposed further inward of the nozzle 102, the volume of the first space $V_1$ can be reduced.

The second space $V_2$ is generally formed to have a volume larger than that of the first space $V_1$. When the main diaphragm 20 of the driver 2 is driven, the presence of the second space $V_2$ may become a factor to resist the vibration. However, when the driver 2 is driven, the second diaphragm B is also moved, and thus resistance attributable to the volume can be alleviated. The second diaphragm B enables low-frequency band sound, transferred via the second space $V_2$, to be reproduced without loss by means of its vibration.

The sound improvement or adjustment capabilities of the first and second diaphragms A and B are influenced by the sizes of the first space $V_1$ and the second space $V_2$ and the thicknesses or lengths of the walls of the housing 100 and the casing 200, and thus design is made to maintain optimum sound quality by taking into account the above factors.

It is preferred that the above-described structure of the earphone 1 of FIG. 4 is applied when the housing 100 is of a sealed or waterproof type. In this case, the first diaphragm A and the second diaphragm B function as boundaries for forming sealed spaces, and blocks the outside and the inside of the earphone 1 from each other. However, the structure of the earphone 1 of FIG. 4 may be appropriately modified, and may be applied to an open case, e.g., a case where a pressure equalizing port is formed in the front of the housing 100 or an additional vent hole is formed in the rear surface of the housing 100.

Figure 5:
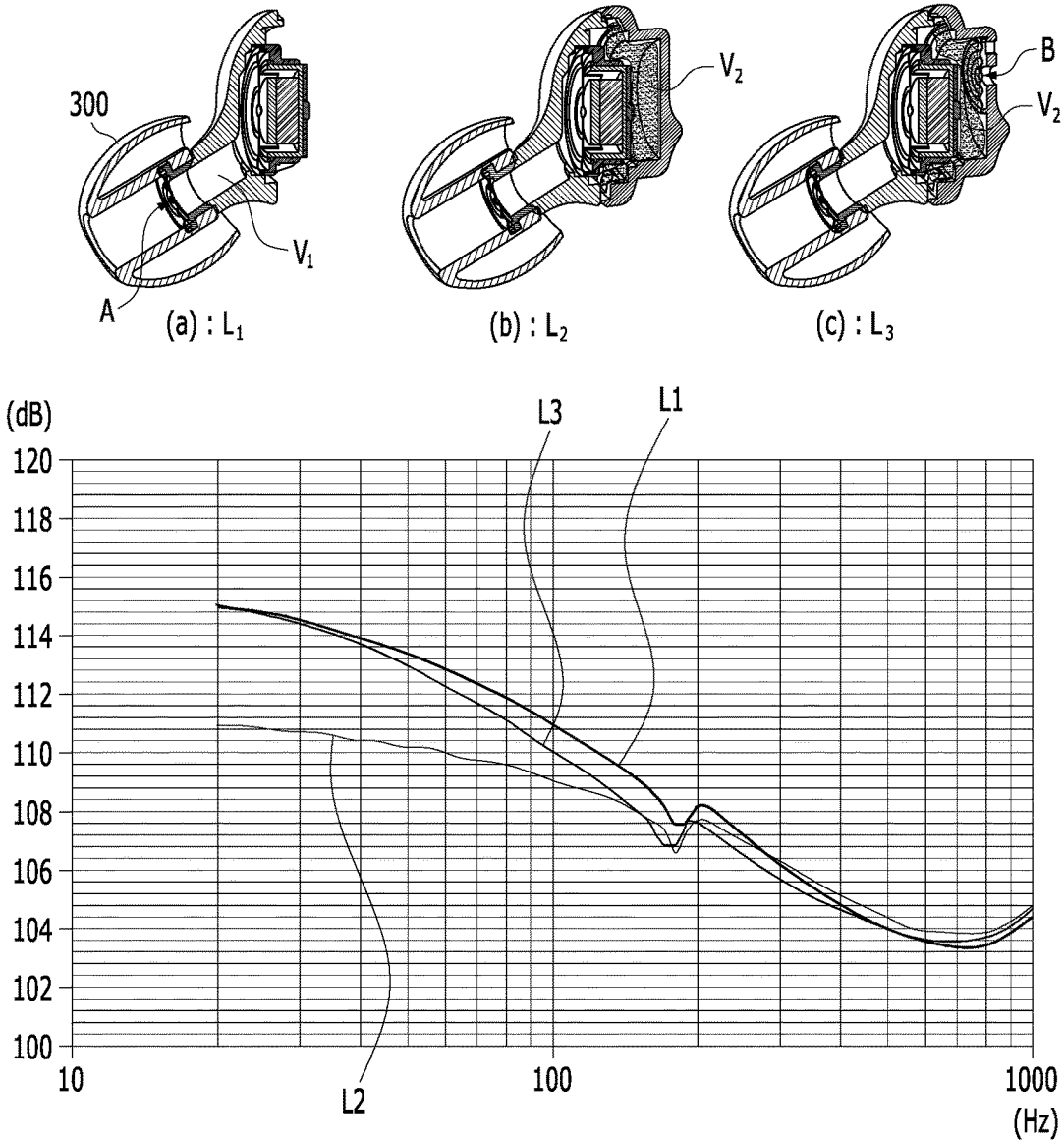
FIG. 5 is a frequency-sound pressure graph showing curves measured at the respective mounting steps of the first and second diaphragms during a process of fabricating the earphone 1 according to the embodiment of the present invention.

FIG. 5 is a frequency-sound pressure graph showing curves measured at the respective mounting steps of the first and second diaphragms A and B during a process of fabricating the earphone 1 according to the embodiment of the present invention.

Curve $L_1$ was measured at step (a) at which the first diaphragm A and the first space $V_1$ were formed without the driver 2 disposed in the rear portion of the housing 100. Curve $L_2$ was measured at step (b) at which the second space $V_2$ was formed by disposing the driver 2 in the rear portion of the housing 100. Curve $L_3$ was measured at step (c) at which the second diaphragm B was disposed in the second space $V_2$.

At step (a), it can be seen that low-frequency band sound pressure characteristics could be maximized. At step (b), the second space $V_2$ was sealed, and thus low-band characteristics were degraded due to resistance attributable to the volume. In particular, a maximum sound pressure loss of 5% occurred in the low band of 20 to 200 Hz. At step (c), the volume behind the housing 100 was sealed and the second diaphragm B was added, and thus low-band sound quality was considerably improved. In particular, the prevention of sound pressure loss was effective in the ultra-low band of 20 to 100 Hz.

Figure 6:
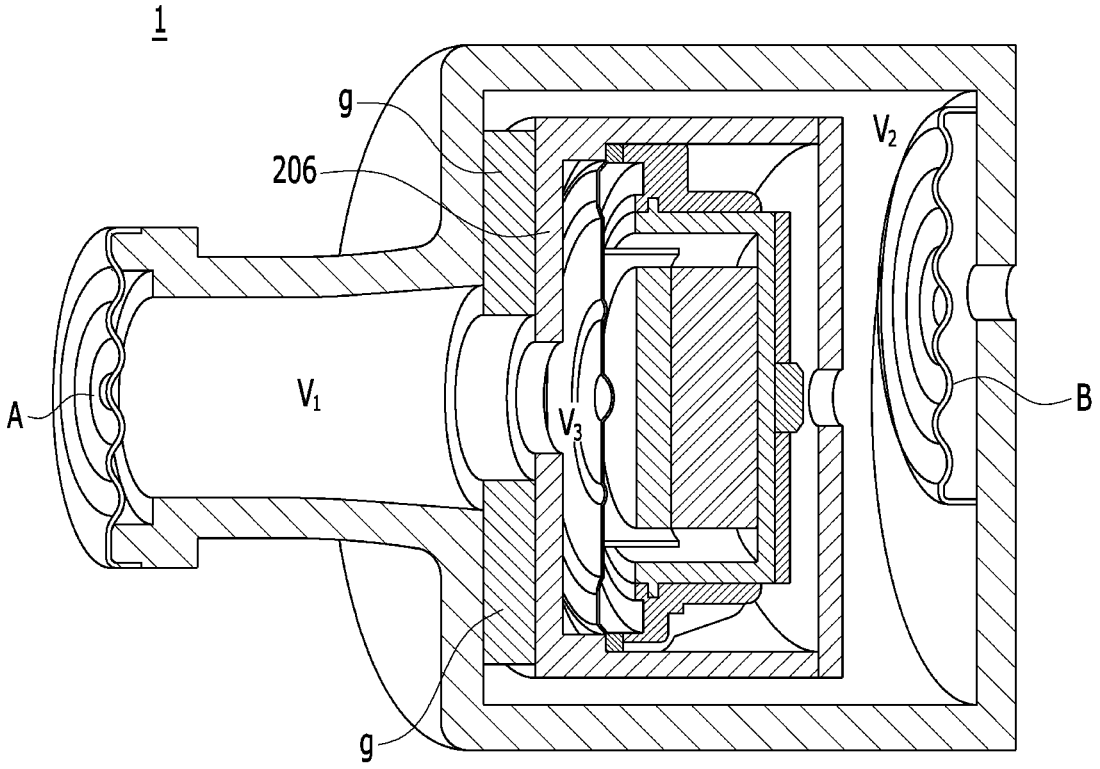
FIG. 6 is a longitudinal sectional view of an earphone having multiple diaphragms according to another embodiment of the present invention.

FIG. 6 is a longitudinal sectional view of an earphone 1 including multiple diaphragms according to another embodiment of the present invention.

The present embodiment is different from the embodiment of FIG. 2 in that a front surface 206 is disposed in a casing 200 and a gap between the front surface 206 and a housing 100 is blocked by a gasket. In the case of FIG. 2, the first space $V_1$ is formed by making the main diaphragm 20 and the nozzle 102 directly communicate with each other without a need to install the front surface in the casing 200. The present embodiment is different from the embodiment of FIG. 2 in that an additional third space $V_3$ is formed between the front surface 206 and a main diaphragm 20. However, those skilled in the art will appreciate that the third space $V_3$ communicates with the first space $V_1$ and is thus included in the latter. The third space $V_3$ may be formed when a driver unit 2 including the casing 200 having one of various shapes is applied.

It will be apparent that the embodiment of FIG. 6 also exhibits the same effects as described above. Those skilled in the art will appreciate that one or more of the variations of the second embodiment may be applied.

The above-described technical spirit of the present invention is characterized in that sound quality can be optimized and low-band sound pressure can be prevented from being lost via the plurality of spaces defined by the plurality of diaphragms. Accordingly, the present invention may be applied to not only a typical earphone but also all sound parts including a speaker, a microphone, etc.

According to the present invention, the plurality of diaphragms is located on the boundaries of the spaces formed by the housing, and thus it is possible to prevent low-band sound pressure from being lost while maintaining the sound quality of the acoustic device.

According to the present invention, the inside of the housing of the acoustic device is divided into the plurality of spaces based on the driver and the respective spaces are defined by the diaphragms, and thus optimum sound quality can be secured by adjusting the sizes of the spaces and the locations where the diaphragms are disposed.

While the foregoing description has been given with reference to the specific embodiments of the present invention, the present invention may be implemented in various other forms. Accordingly, the described embodiments are provided to make the disclosure of the present invention thorough and complete and to fully convey the scope of the present invention to those having ordinary knowledge in the art to the present invention pertains. The present invention is defined by the attached claims.

What is claimed is:

1. An acoustic device having multiple diaphragms, the acoustic device comprising:

a housing configured to form an appearance of the acoustic device;

a driver disposed inside the housing, and including a main diaphragm; and an additional diaphragm disposed at a boundary of a space formed by the housing or adjacent to the boundary;

wherein the space formed by the housing includes a first space formed on one side and a second space formed at a side opposite to the one side based on the driver, the additional diaphragm includes a first diaphragm disposed at a boundary of the first space or adjacent to the boundary and a second diaphragm disposed at a boundary of the second space or adjacent to the boundary, and the first space is sealed from an outside by the first diaphragm and is configured to have a predetermined volume such that a vibration of the main diaphragm is substantially transferred to the first diaphragm.

2. The acoustic device of claim 1, wherein the second space is sealed from the outside by the second diaphragm.

3. An earphone having multiple diaphragms, the earphone comprising:

a housing configured to form an appearance of the earphone while surrounding the earphone;

a driver disposed inside the housing, and including a main diaphragm; and an additional diaphragm disposed at a boundary of a space formed by the housing or adjacent to the boundary;

wherein the space formed by the housing includes a first space formed on one side and a second space formed at a side opposite to the one side based on the driver, the additional diaphragm includes a first diaphragm disposed at a boundary of the first space or adjacent to the boundary and a second diaphragm disposed at a boundary of the second space or adjacent to the boundary, and the first space is sealed from an outside by the first diaphragm and is configured to have a predetermined volume such that a vibration of the main diaphragm is substantially transferred to the first diaphragm.

4. The earphone of claim 3, wherein the second space is sealed from the outside by the second diaphragm.

5. The earphone of claim 3, wherein the housing includes a nozzle configured to emit sound to an inside of an ear of a user in the first space, and the first diaphragm is disposed at a location that covers the nozzle.

6. The earphone of claim 3, wherein the housing has an opening formed behind the second space as a vent hole, and the second diaphragm is disposed at a location that covers the opening.

7. The earphone of claim 3, wherein the second diaphragm is a mesh-type membrane that passes air therethrough and does not pass water therethrough.

* * * * *